US006367620B1

(12) United States Patent
Kelifa

(10) Patent No.: US 6,367,620 B1
(45) Date of Patent: Apr. 9, 2002

(54) DEVICE FOR REGULATING RELATIVE HUMIDITY

(76) Inventor: Robert Gilles Kelifa, 2, Place Francis Chirat, 13002 Marseille (FR)

( * ) Notice: Subject to any disclaimer, the term of this patent is extended or adjusted under 35 U.S.C. 154(b) by 0 days.

(21) Appl. No.: 09/622,195

(22) PCT Filed: Dec. 15, 1999

(86) PCT No.: PCT/FR99/03152

§ 371 Date: Aug. 11, 2000

§ 102(e) Date: Aug. 11, 2000

(87) PCT Pub. No.: WO00/35769

PCT Pub. Date: Jun. 22, 2000

(30) Foreign Application Priority Data

Dec. 15, 1998 (FR) ..... 98/16152

(51) Int. Cl.[7] ..... B65D 81/26
(52) U.S. Cl. ..... 206/1.9; 206/204
(58) Field of Search ..... 206/1.8, 1.9, 204; 312/31.01, 31.03, 31.05, 31.1

(56) References Cited

U.S. PATENT DOCUMENTS 5,148,613 A * 9/1992 Cullen
5,241,149 A * 8/1993 Watanabe et al. ..... 206/204
5,686,161 A * 11/1997 Cullen et al. ..... 428/68

* cited by examiner

*Primary Examiner*—David T. Fidei
(74) *Attorney, Agent, or Firm*—Cohen, Pontani, Lieberman & Pavane

(57) ABSTRACT

A device for regulating the relative humidity of a closed chamber includes a layer of material capable of being impregnated with liquid and of adsorbing or desorbing vapor of the liquid. The material has on one of its surfaces a membrane which is permeable to vapor but not to liquid. The membrane having an outer surface which is hydrophobic. The adsorbent/desorbent material can be arranged in a sealed tank with an opening for filling with liquid. The device is especially suitable for a paint palette in a chamber having a cover, so that paint can remain on the hydrophobic surface without drying.

12 Claims, 1 Drawing Sheet

DEVICE FOR REGULATING RELATIVE HUMIDITY

BACKGROUND OF THE INVENTION

The present invention concerns a device for regulating relative humidity.

It is especially intended for producing paint palettes with a movable impervious cover for, contrary to the case with conventional palettes, keeping the paint as malleable as when it first came out of the tube without drying for many days.

The device may, however, be used for a large number of other applications, for example:

- pots or moistening containers for preserving substances impregnated with water or solvents, such as pastes, gels, masses and various mixtures,
- shop windows, suitcases, display or transport boxes kept constantly moistened so as to preserve and conserve works of art,
- cigar boxes, miscellaneous packaging boxes,
- moistening of dry products,
- etc.

DESCRIPTION OF THE RELATED ART

To date, there are a large number of systems or products for preventing deterioration of the contents of a chamber by means of drying, or on the contrary via the absorption of excessive humidity.

By way of example, it is possible to cite the product "ART.SORB" of the "FUJI SILYSIA Chemical Ltd" appearing in the form of pearls, leaves or cassettes able to adsorb or desorb humidity from the air and intended for preserving works of art.

The patent N°FR 2 656 848 describes a paint pail comprising a cover with a gasket equipped with a moistening device provided with holes allowing the solvent soaking a sponge placed in said moistening device to pass towards the inside of the pail.

SUMMARY OF THE INVENTION

The device of the invention makes it possible to compensate the evaporation of water or solvents contained in the product so as to delay, slow down or even stop it drying and hardening so as to retain its initial state prior to evaporation, thus retaining its original malleability. It also enables a product to be re-impregnated with water or solvents if its nature so allows, as to restore its malleability or on the contrary extract the water or solvent vapours from the content of a container.

It consists of a closed chamber equipped with a regulating relative humidity system made up of a material able to be impregnated with liquid and able to adsorb or desorb the vapor of this liquid. The material includes on one of its faces a membrane permeable to vapor but not liquid, the membrane having an exposed surface which is hydrophobic, the other face of the absorbent desorbent material possibly including a membrane permeable to vapor in a single direction making it possible to render the system self-moistening or self-drying according to the direction of permeability of the membrane.

BRIEF DESCRIPTION OF THE DRAWINGS

There now follows a description of the embodiments of the invention given by way of non-restrictive examples with reference to the accompanying drawings on which.

DETAILED DESCRIPTION OF THE PRESENTLY PREFERRED EMBODIMENTS

The device shown on FIGS. 1 to 4 is formed by associating a membrane 1 permeable to water vapour comprising a hydrophobic face 2 and a layer 3 of an adsorbing-desorbing material able to be conditioned at a specific percentage of relative humidity, the entire unit being included in a closed chamber 4.

Figure 1:
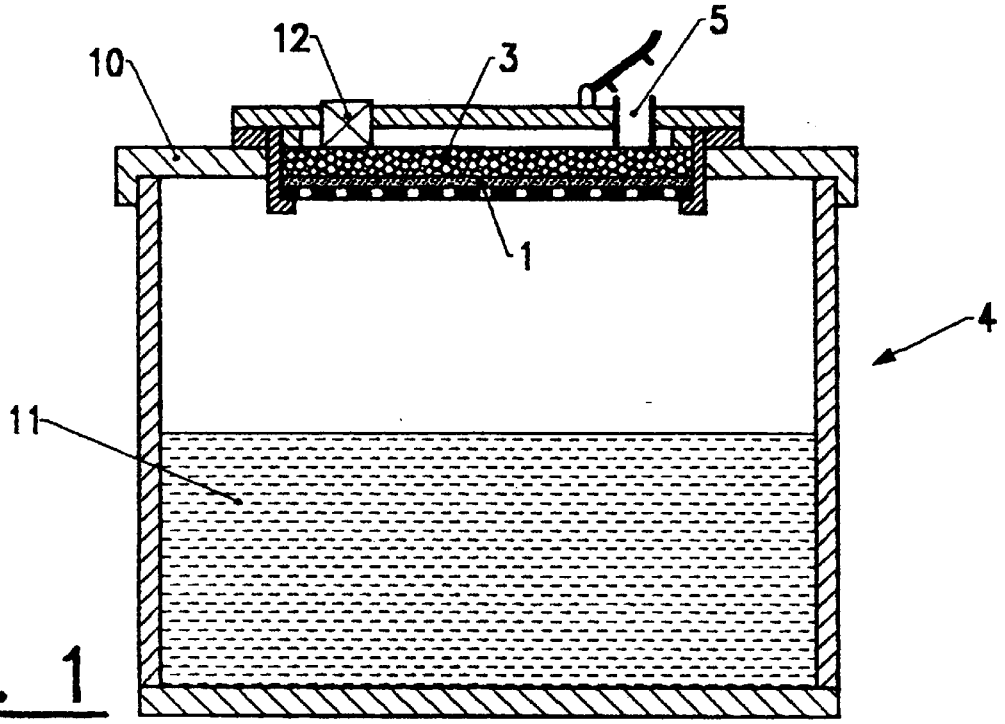
FIG. 1 is a vertical cross sectional view showing the chamber comprising at its upper portion a device for regulating humidity with a liquid reserve.
Figure 2:
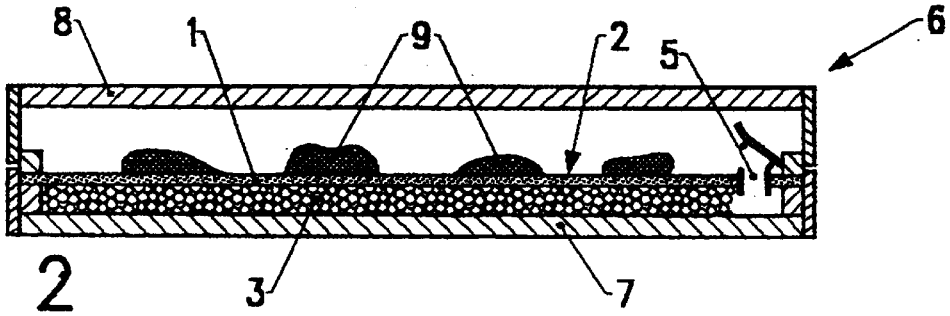
FIG. 2 shows in the same conditions a paint palette equipped with a sealed cover with a liquid reserve humidity regulating device placed at the bottom of the chamber.

The adsorbing-desorbing material 3 can be placed in an impervious water tank with an internal opening for filling 5 (FIG. 2) or an extreme opening (FIG. 1). The material adsorbs the water poured into this tank until it is saturated and desorbs said water at the desired percentage of relative humidity through the membrane 1. This membrane is placed against a face of the layer 3 so as to have a free hydrophobic outer surface. The system compensates the increase or lowering of relative humidity according to a proportion linked to the volume of the chamber 4 it is desired to keep at a stable relative humidity (FIGS. 1 and 2).

This arrangement particularly allows the production of a paint palette 6 constituted by a bottom 7 and an articulated or movable sealed cover 8. The humidity regulating device extends over the entire surface of the bottom and the paint 9 is directly laid on the hydrophobic surface of the membrane 1, which, combined with retaining the humidity inside the chamber formed by the bottom 7 and the cover 8, makes it possible to keep for a prolonged period the paint 9 in the condition it was when it first came out of the tube. This palette can be used for all water-based paints (acrylic, gouache, water colour, etc.) (FIG. 2). The upper peripheral surface of the tank can comprise holes favouring evaporation of the liquid so as to increase humidity inside the chamber.

A porous plate can be inserted between the bottom of the chamber 4 and the adsorbing-desorbing layer 3 communicating with a filling opening or an outer tank so as avoid water saturation in the layer 3.

For certain applications, a second inverted regulating device is placed in the cover and fitted so as to favour passage of the vapour from inside to outside. This arrangement makes it possible to moisten certain objects or products placed on the hydrophobic surface of the membrane 1 of the regulating unit of the bottom. It can particularly be applied so as to treat fine drawings.

So as to improve the diffusion of humidity inside the membrane 1, a porous plate, possibly rigid (not shown), could advantageously be provided between the membrane 1 and the adsorbing-desorbing layer 3.

According to one embodiment variant, the liquid tank is placed below the membrane 1/adsorbing-desorbing layer 3 unit and the humidity is transmitted via attraction to the membrane 1 by means of a porous sheet of material placed under this layer and extended downwards so as to soak in the liquid. This variant can in particular be used to produce chambers making possible to keep plants in pots for a prolonged period without needing to be watered.

The humidity regulating device can equally be placed at the upper or lower portion of the chamber. It can in particular be placed in the cover 10 of a container, such as the pot 11 for preserving paint, glue, plastic mass or other products having a tendency to dry. Advantageously, a humidity indicator 12 could be provided in contact with the adsorbing-desorbing material and visible from the outside making it possible at any moment to check if there is enough water in the tank (FIG. 1).

Figure 3:
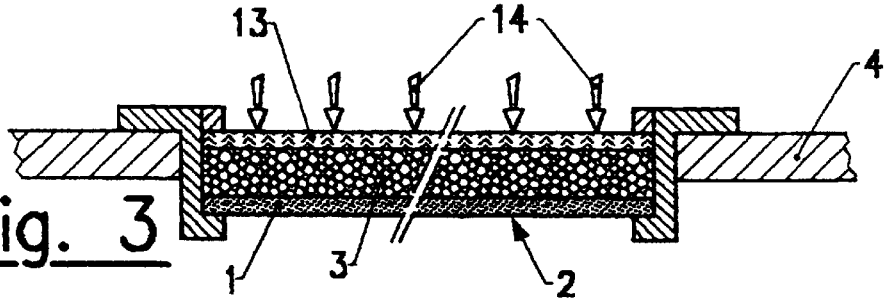
FIGS. 3 and 4 are cross sectional views of the humidity regulating device without any liquid reserve for respectively retaining a percentage of humidity higher and lower than the one existing outside the chamber equipped with the humidity regulating device.

If the humidity regulating device is produced with the adsorbing-desorbing material layer 3 sealed between a membrane 1 permeable to water vapour in two directions on one face, and a second membrane 13 permeable to water vapour in only one direction directed towards the back of the adsorbing material (arrows 14), the system becomes self-moistening and does not need any liquid reserve. It acts like a humidity condenser in the direction of the outside of the two direction membrane 1 (FIG. 3).

Figure 4:
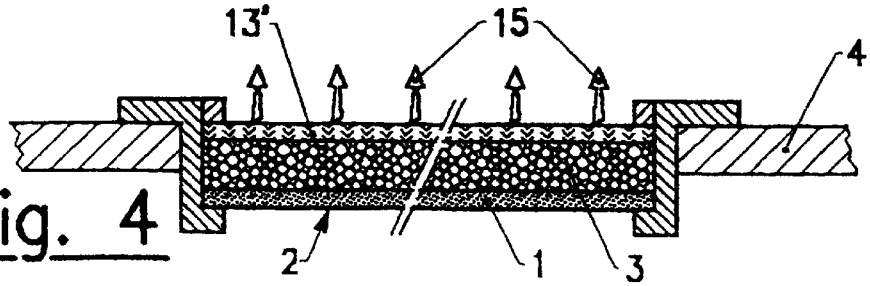

On the contrary, if the permeability direction of the second membrane 13' is inverted (arrows 15), the system acts as a permanent dehumidifier outside the two direction membrane 1 (FIG. 4).

The adsorbing-desorbing material layer 3 shall advantageously consist of unsaturate salts or a silica gel able to be conditioned for a desired percentage of relative humidity by a prolonged passage in an oven kept at this percentage, and the membrane 1 made of expanded polytetrafluorethylene (PTFE). This material is highly permeable to gases whilst being at the same time impermeable to liquids. In addition, its surface fully hydrophobic and not staining which makes the material particularly effective as regards the paint palette 6 which also washable and able to be reused immediately. The membrane 1 can be made of a very thin film or a porous sheet.

The device described above can be used for a large number of applications in various fields.

With a sealed water reserve, it is possible to equip for example cigar boxes, clay preservation boxes, glass cases, seeds and cutting boxes, or displaying floral arrangements, bonsai trees, etc.

With a second membrane 13, 13' permeable in a single direction, it can be used for the preceding applications without water being added and further allows the embodiment of wall panels in contact with the outside world and intended for humidity compensation of excessively dry rooms (central heating) or on the other hand excessively humid rooms. It can also be used to trap water in hot countries or as a permanent auto-dryer of various containers, such as boxes, canisters or bags.

The system of the invention with its sealed reserve can also be used to avoid the drying of non-aqueous products and in particular for paint pallets with varnish or fast-drying oil paint or even for glycerolphtalic paint or varnish pots for preserving pasty waxes. In this case, the liquid reserve is filled with a water mixture and a proportion able to be tolerated by the membrane 1 with solvent, this membrane and the adsorbent/desorbent material being embodied from products adapted to water.

The non-aqueous solvent can also not be diluted in water, the adsorbent material layer 3 and the membrane 1 then being embodied in specific materials compatible with this solvent.

The positioning of the various main elements provides the object of the invention with a maximum of useful effects which to date had never been obtained using similar devices.

What is claimed is:

1. A device for regulating the relative humidity of a closed chamber to compensate for the evaporation of liquid from said closed chamber, said device comprising a tank comprising a filling opening for adding a liquid to said tank, a layer of adsorbent/desorbent material located so that said layer of material can be impregnated with said liquid by adding said liquid to said tank, a membrane which is impervious to said liquid but permeable to vapor of said liquid, said membrane being disposed on said layer of material, whereby the humidity of a closed chamber may be regulated by adding liquid to said tank and exposing said membrane to said chamber.

2. A device as in claim 1 wherein said layer of adsorbent/desorbent material is located in said tank, said tank being bounded in part by said membrane.

3. A device as in claim 1 wherein the device is placed in a cover of said closed chamber.

4. Device according to claim 1, wherein the adsorbent/desorbent material is made up of a silica gel.

5. Device according to claim 1, wherein the membrane is made of expanded polytetrafluoroethylene (PTFE) having permeability to gases while being impermeable to liquids.

6. Device according to claim 1, further comprising a porous plate inserted between the membrane and the adsorbent/desorbent layer.

7. Device according to claim 1, wherein the adsorbent/desorbent layer is placed in a sealed liquid reserve with a filling opening.

8. Device according to claim 7 further comprising a humidity indicator in contact with the adsorbent/desorbent material and visible from the outside making it possible to know at any moment if the amount of liquid in the tank is sufficient.

9. Device according to claim 1, wherein the device is placed at the bottom of said chamber.

10. Device according to claim 9, said chamber is a paint palette comprising a bottom and a movable sealed cover, the layer of adsorbent/desorbent material extending over the bottom and the paint being laid directly on the membrane.

11. Device according to claim 9, wherein a porous plate is inserted between the bottom of the chamber and the adsorbent/desorbent layer, said plate communicating with said tank.

12. Device according to claim 9, further comprising a second membrane placed in the cover and arranged to permit passage of vapor from inside to outside.

* * * * *